US009851174B1

(12) United States Patent
Bailey

(10) Patent No.: US 9,851,174 B1
(45) Date of Patent: Dec. 26, 2017

(54) PISTOL WITH IMPROVED GRIP

(71) Applicant: Derek J. Bailey, Culpeper, VA (US)

(72) Inventor: Derek J. Bailey, Culpeper, VA (US)

( * ) Notice: Subject to any disclaimer, the term of this patent is extended or adjusted under 35 U.S.C. 154(b) by 0 days.

(21) Appl. No.: 15/160,336

(22) Filed: May 20, 2016

Related U.S. Application Data

(60) Provisional application No. 62/165,008, filed on May 21, 2015.

(51) Int. Cl.
*F41C 23/10* (2006.01)
*F41C 3/00* (2006.01)

(52) U.S. Cl.
CPC ..... *F41C 3/00* (2013.01); *F41C 23/10* (2013.01)

(58) Field of Classification Search
CPC ..... F41C 23/10; F41C 23/12; F41C 23/16
USPC ..... 42/85, 90, 106; D22/108
See application file for complete search history.

(56) References Cited

U.S. PATENT DOCUMENTS 297,412 A * 4/1884 Kelton ..... F41C 23/10 42/71.02
1,049,739 A * 1/1913 Leach, Jr. ..... F41C 23/10 42/71.02
1,898,368 A * 2/1933 Hess ..... F41C 23/10 42/71.02
2,437,404 A * 3/1948 Robinson ..... A63B 53/14 473/203
D163,654 S * 6/1951 Vahala ..... D22/104
3,128,571 A * 4/1964 Herrett ..... F41C 23/10 42/71.02
3,397,475 A * 8/1968 Mikus ..... F41C 23/10 42/59
D252,694 S * 8/1979 Schiermeier ..... D22/108
D255,917 S * 7/1980 Merrill ..... 42/71.02
4,638,582 A * 1/1987 Farrar ..... F41C 23/10 42/71.02
D349,938 S * 8/1994 Hogue ..... D22/104
D351,448 S * 10/1994 Fisher ..... 42/71.02
D351,638 S * 10/1994 Scott ..... 42/71.02
D354,110 S * 1/1995 Scott ..... D22/104
5,406,731 A * 4/1995 Stevens ..... F41C 23/10 42/71.02
5,469,601 A * 11/1995 Jackson ..... A47J 45/10 16/421
5,551,413 A * 9/1996 Walk ..... F41B 5/14 124/23.1
D374,903 S * 10/1996 Pearce ..... D22/104
(Continued)

*Primary Examiner* — Joshua Freeman
(74) *Attorney, Agent, or Firm* — Gilberto M. Villacorta; Kiri Lee Sharon; Foley & Lardner LLP

(57) ABSTRACT

A firearm includes a trigger and a handle. The handle is configured to be gripped by the hand of a user of the firearm. The handle includes a front portion located under the trigger and facing the firing direction, a back portion located on a rear side of the handle facing a direction opposite of the firing direction, and primary and secondary side portions located between the front portion and the back portion. The primary side portion is configured to receive the shooting hand of the user and the secondary side portion is configured to receive the support hand of the user. The secondary side portion includes an elongated ridge protruding away from a surface of the secondary side portion. The ridge is configured to engage a heel of the support hand thereby allowing the support hand to absorb a portion of a recoil force when the firearm is fired.

20 Claims, 3 Drawing Sheets

(56) References Cited

U.S. PATENT DOCUMENTS

D377,304 S * 1/1997 Hogue ..... D8/70
5,621,997 A * 4/1997 Pearce ..... F41C 23/10 42/7
D382,458 S * 8/1997 Hogue ..... D8/70
D393,194 S * 4/1998 Hogue ..... D8/303
5,867,868 A * 2/1999 Ward ..... A63B 49/08 16/422
D410,988 S * 6/1999 Hines ..... D22/100
6,802,148 B1 * 10/2004 Danas ..... F41C 23/10 42/71.02
6,804,907 B1 * 10/2004 Slobodkin ..... F41C 23/14 42/71.01
D716,404 S * 10/2014 Capps ..... D22/108
9,310,161 B2 * 4/2016 Ermossa ..... F41C 23/10
2003/0228929 A1 * 12/2003 Miyasu ..... A63B 53/14 473/300
2005/0188587 A1 * 9/2005 Danas ..... F41C 23/10 42/72
2006/0068148 A1 * 3/2006 Ulrich ..... A63B 53/14 428/41.8
2006/0096147 A1 * 5/2006 Gussalli Beretta ..... F41C 23/10 42/71.02
2006/0287124 A1 * 12/2006 Han ..... A63B 53/14 473/300
2010/0212202 A1 * 8/2010 Roth ..... F41C 23/10 42/71.01
2010/0263254 A1 * 10/2010 Glock ..... F41A 11/02 42/71.02
2010/0298063 A1 * 11/2010 Gill ..... A63B 53/14 473/303
2011/0167698 A1 * 7/2011 Hoguc ..... F41C 23/10 42/71.02
2011/0258900 A1 * 10/2011 Sims ..... F41C 23/08 42/71.02
2011/0289812 A1 * 12/2011 Losinger ..... F41C 23/10 42/72
2013/0217523 A1 * 8/2013 Johnson ..... F42B 6/003 473/516
2015/0300775 A1 * 10/2015 Combs ..... F41C 23/16 42/72
2016/0313086 A1 * 10/2016 Maroney ..... F41C 23/10
2016/0377139 A1 * 12/2016 Vito ..... F16F 3/093 267/141

* cited by examiner

PISTOL WITH IMPROVED GRIP

CROSS REFERENCE TO RELATED APPLICATIONS

This application claims the benefit of U.S. Provisional Application No. 62/165,008 filed May 21, 2015, the entire disclosure of which is incorporated herein by reference.

BACKGROUND

A proper grip is one of the critical components involved in shooting a pistol. The recoil that results from shooting a pistol can cause a shooter to lose their grip after only a few shots. As a result, there are many pistol grips on the market today. Some are designed solely for appearances, while others are built to provide the shooter with a better grip on the pistol. However, many grips do not allow the support hand to grip the weapon as securely as the strong hand.

When fired, a firearm, such as a pistol, produces a recoil force directed towards the rear of the weapon. The problem with traditional pistol grips is that they have been designed to be held by a person's dominant hand. Examples of this are competitive bulls-eye shooting which still uses one hand and the fact that FBI agents, in the past, were taught to crouch and shoot with their dominant hand only. Almost as an afterthought, the off-hand is then added for additional support. There are various methods taught that help the off-hand provide more support, but the majority of new and experienced shooters struggle with their support hand slipping as the pistol is fired. This results in the strong hand having to grip the pistol more firmly to maintain control. When the strong hand grips too hard, the shot is affected and the shooter has difficulty hitting the intended target.

SUMMARY

One disclosed embodiment relates to a firearm comprising a trigger and a handle. The handle is configured to be gripped by the hand of a user of the firearm. The handle includes a front portion located under the trigger and facing the firing direction, a back portion located on a rear side of the handle facing a direction opposite of the firing direction, and primary and secondary side portions located between the front portion and the back portion. The primary side portion is configured to receive the shooting hand of the user and the secondary side portion is configured to receive the support hand of the user. The secondary side portion includes an elongated ridge protruding away from a surface of the secondary side portion. The ridge is configured to engage a heel of the support hand thereby allowing the support hand to absorb a portion of a recoil force when the firearm is fired. In a disclosed embodiment, the ridge is curved. The ridge may also form a swale to better accept the heel of the support hand. In one disclosed embodiment, the ridge extends greater than 50 percent of the vertical length of the secondary side portion, which secondary side portion preferably includes a removable panel and wherein the ridge is located on the removable panel. In yet another disclosed embodiment, the ridge is formed of pliable material and, preferably, protrudes at least 0.25 inches away from a surface of the secondary side portion.

Another disclosed embodiment relates to a handgun including a handle with a grip assist feature. The grip assist feature includes a sleeve surrounding the handle. The sleeve includes a protruding portion extending along a side of the handle so that that the protruding portion engages a heel of a non-shooting hand thereby allowing the non-shooting hand to absorb a portion of a recoil force when the handgun is fired. In one disclosed embodiment, the protruding portion extends substantially along the entire length of the side of the handle. The protruding portion may comprise an elongated insert located within the sleeve. Moreover, the insert may have a cross-section that is one of circular, square, rectangular, or triangular geometry. The insert may also be integrated into the sleeve. In yet another disclosed embodiment, the position of the insert relative to the sleeve is adjustable, and the protruding portion may extend in a curved shape. In one disclosed embodiment, the shape of the protruding portion is adjustable by the user.

Another disclosed embodiment relates to a firearm including a handle configured to be gripped by a shooting hand of a user, while a finger on the shooting hand of the user activates a trigger of the firearm. In such an embodiment, the handle includes primary and secondary side portions in which the primary side portion is configured to receive the shooting hand of the user and the secondary side portion is configured to receive a support hand of the user. Moreover, the secondary side portion includes a grip assist feature configured to engage a heel of the support hand, which allows the support hand to absorb a portion of a recoil force when the firearm is fired. In a disclosed embodiment the grip assist feature includes a protruding portion extending along at least a portion of a length of the secondary side portion. The grip assist feature may include a sleeve surrounding the handle and including the protruding portion, which may comprise an elongated insert located within the sleeve. In one disclosed embodiment the grip assist feature includes pliable material. The grip assist feature may further include a ridge extending along at least a portion of a length of the secondary side portion. In another disclosed embodiment, the secondary side portion includes a removable panel and wherein the ridge is located on the removable panel. The ridge is optionally formed of pliable material and protrudes at least 0.25 inches away from a surface of the secondary side portion.

Yet another disclosed embodiment relates to a method of stabilizing a handgun with a support (non-shooting) hand. The method includes gripping a handle of a handgun with a shooting hand, and positioning a heel of a support hand on or against a surface of a grip assist feature present on a side (the support side) of the handle opposite that which is in contact with a palm of the shooting hand. The grip assist feature includes an elongated rise or ridge running along at least a portion of a length of the support side and positioned between a distal face and a proximal face of the handle so that one or more fingertips of the shooting hand rest on a side of the grip assist feature, which is opposite the surface on or against which the heel of the support hand is positioned. In a disclosed embodiment, the elongated rise or ridge is positioned about midway between the distal face and the proximal face of the handle. In another disclosed embodiment, the surface of the grip assist feature forms a swale to better accept the heel of the support hand.

It is to be understood that both the foregoing general description and the following detailed description are exemplary and explanatory only, and are not restrictive of the invention as claimed.

BRIEF DESCRIPTION OF THE DRAWINGS

Features, aspects, and advantages of the present invention will become apparent from the following description, appended claims, and the accompanying exemplary embodiments shown in the drawings, which are briefly described below.

DETAILED DESCRIPTION

Figure 1:
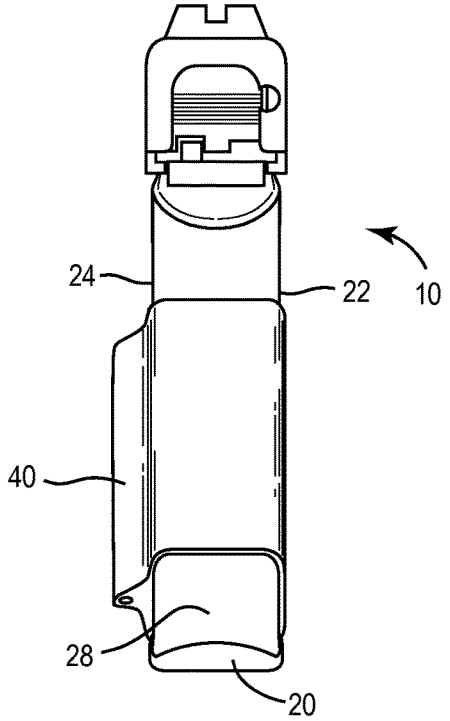
FIG. 1 is a rear view of a pistol including a grip configured to be better gripped by the support hand of the shooter, according to an exemplary embodiment.
Figure 2:
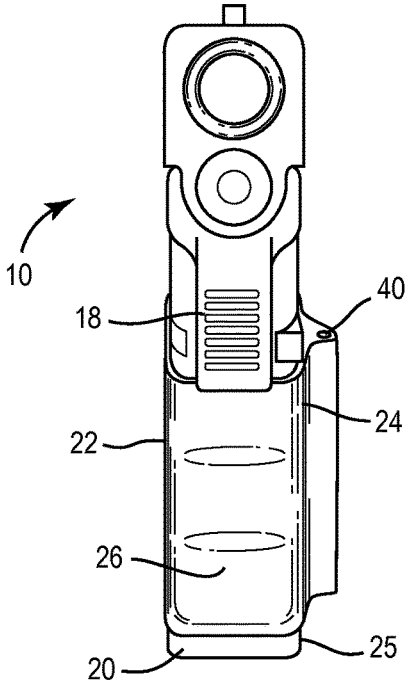
FIG. 2 is a front view of the pistol of FIG. 1.
Figure 3:
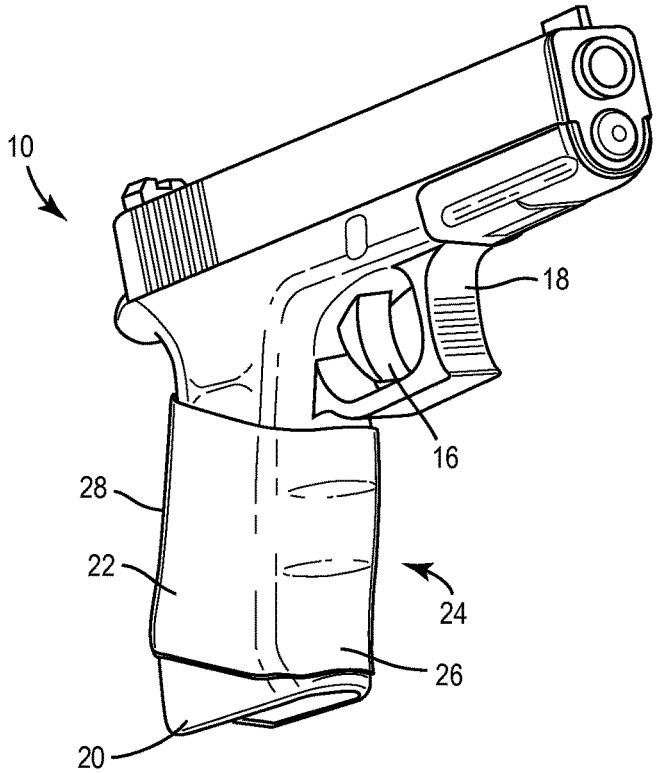
FIG. 3 is a right front perspective view of the pistol of FIG. 1.
Figure 4:
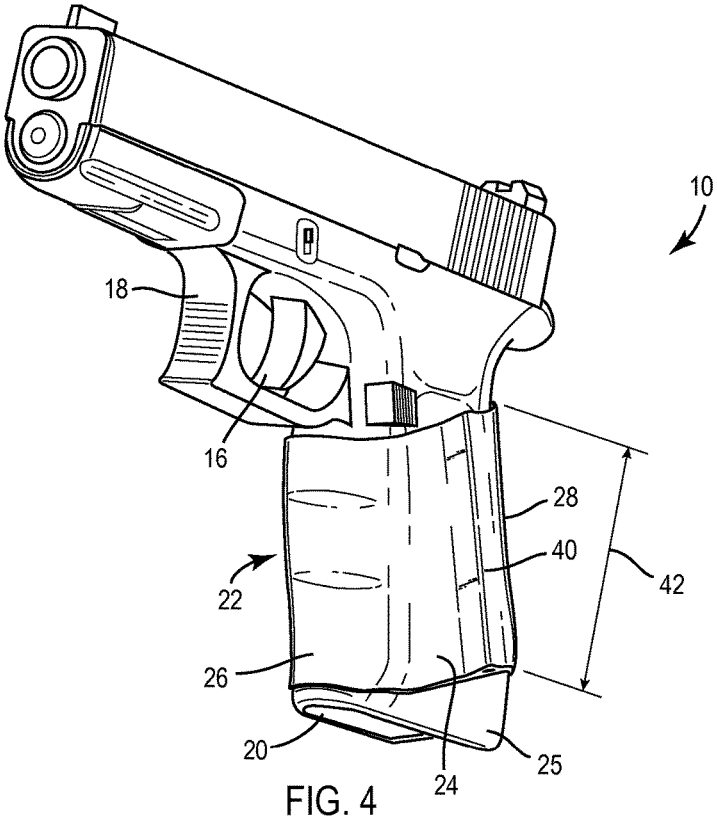
FIG. 4 is a left front perspective view of the pistol of FIG. 1.
Figure 5:
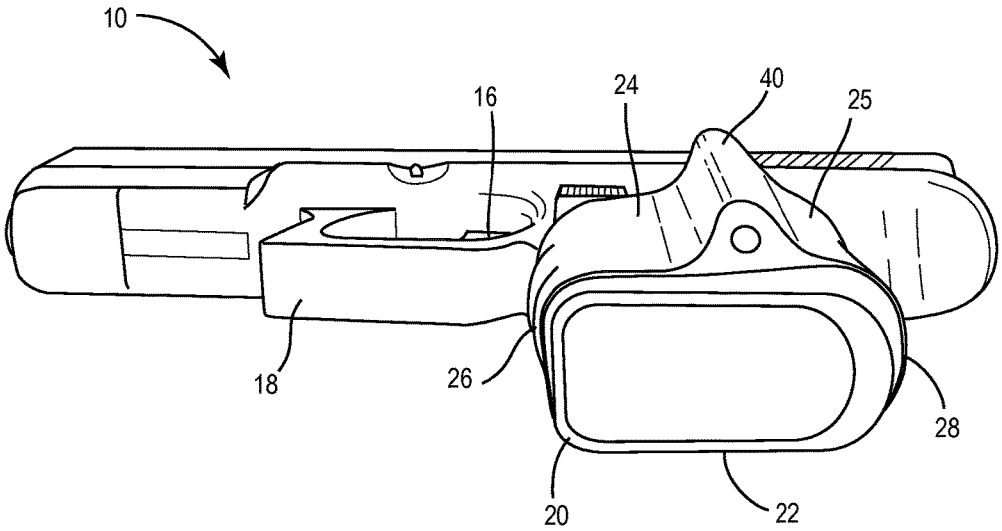
FIG. 5 is a left bottom perspective view of the pistol of FIG. 1.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Referring to FIGS. 1-5, a firearm is shown as a pistol 10, which includes a barrel, a chamber containing a round and in communication with the barrel, and trigger 16 configured to activate a firing mechanism when pulled. The trigger 16 is disposed below the barrel 12 and is surrounded by a trigger guard 18. The pistol 10 further includes a handle 20 that is configured to be gripped by the hand of a user of the pistol 10. The handle 20 positions a first hand of the user (e.g., a shooting hand) such that it can engage the trigger 16 to fire the pistol. The handle 20 may further be gripped by a second hand (e.g., a support hand) to steady the pistol 10. The handle 20 projects downward from the barrel. The handle 20 may be a generally hollow body configured to receive a magazine or clip containing additional rounds through an opening in the distal end of the handle 20.

The handle 20 includes a primary or first side portion 22 and secondary or second side portion 24. The primary side portion 22 is configured to receive the shooting hand of the user and the secondary side portion 24 is configured to receive the support hand of the user. The side portions 22 and 24 extend between a front portion 26 (e.g., forward-facing direction, firing-facing direction, etc.) and a back portion 28. The front portion 26 is disposed under the trigger 16. The back portion 28 is located on a rear side of the handle 20 facing a direction opposite of the firing direction. The front portion 26 and the back portion 28 may be externally curved or rounded. The side portions 22 and 24 are generally flat, vertically planar faces.

Typically, the shooter's shooting hand grips the handle 20 such that the index finger rests on the first side portion 22 near the trigger 16 and the thumb rests on the second side portion 24. The other three fingers of the shooting hand are wrapped around the front portion 26 below the trigger guard 18. The support hand may be placed on the pistol 10 in several ways. In one technique, the support hand is placed on the second side 24 of the handle 20. The fingers of the support hand are wrapped around the fingers of the shooting hand that are wrapped around the front portion 26 of the handle 20 (e.g., the fingers of the support hand are likewise wrapped around the front portion 26 of the handle 20). The heel of the support hand rests on the second side portion 24 of the handle 20 proximate to the back portion 28.

According to an exemplary embodiment, the second side portion 24 includes an elongated ridge 40. The ridge 40 protrudes outward (e.g., sideways) from an outer surface 25 of the second side portion 24. The ridge 40 is configured such that, when a user grasps the handle 20 with the shooting hand and the support hand, the ridge 40 engages a heel of the support hand. The ridge 40 provides additional space and a specific location for the non-dominant support hand to establish and maintain a grip on the pistol 10 when the pistol 10 is fired and recoil is felt. A portion of the recoil force is transferred to the support hand through the rear face 41 of the ridge 40. In this way, the shooter is able to better control the pistol 10 when firing.

The ridge 40 may be curved to better receive the heel of the support hand such that the support hand can grasp the handle 20 comfortably and absorb a portion of the recoil force. For example, the ridge 40 may be curved in a concave manner towards the back portion 28 of the handle 20. The ridge 40 may extend over the entire vertical length of the handle 20 or may extend over only a portion of the vertical length of the handle 20. According to an exemplary embodiment, the ridge 40 has a length 42 that extends over at least 50% of the vertical length of the handle 20. The ridge 40 may be disposed at any location along the vertical length of the handle 20. According to an exemplary embodiment, the ridge 40 is disposed towards the bottom of the handle 20 to be better aligned with the heel of the support hand.

Figure 6:
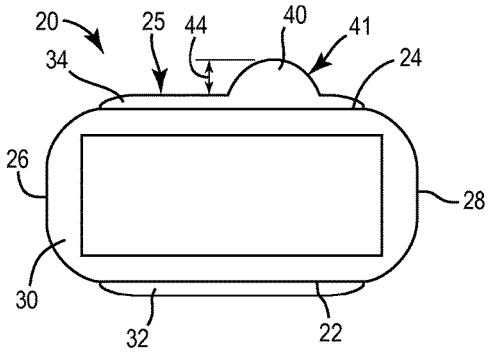
FIG. 6 is a bottom view of a pistol handle, according to an exemplary embodiment.

Referring to FIG. 6, the side portions 22 and 24 may include a first panel 32 (e.g., first grip portion, first cover, etc.) and a second panel 34 (second grip portion, second cover, etc.), respectively. The panels 32 and 34 are contoured to facilitate the grasping of the handle 20 by a user of the pistol 10. The panels 32 and 34 may be coupled to an internal frame or receiver 30, as shown in FIG. 6. For example, the panels 32 and 34 may be coupled to the receiver 30 with mechanical fasteners (e.g., screws, rivets, pins, etc.), integrally formed fasteners (e.g., snap features), adhesives, or any other suitable fastening method. In other embodiments, the first panel 32 and the second panel 34 may be a single unitary body that is slid over the handle 20.

Figure 7:
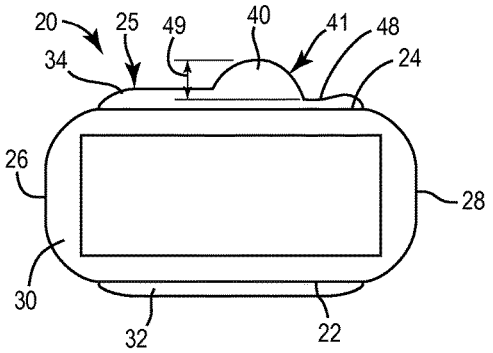
FIG. 7 is a bottom view of a pistol handle, according to another exemplary embodiment.

According to one exemplary embodiment, the ridge 40 has a height 44 (i.e., distance from base of side portion to peak of ridge) of between about 0.25 inches to about 0.5 inches relative to the typical outer surface 25 of the handle. The height may be adjusted for the shooter's preference. According to an exemplary embodiment, the ridge 40 has a cross-sectional shape that is substantially semi-circular. The ridge 40 is shaped such that the rear face 41 of the ridge 40 can transfer recoil force to the heel of the support hand. Referring to FIG. 7, according to another exemplary embodiment, the second side portion 24 may be further contoured with a depression or swale 48 provided to the rear of the ridge 40, with the swale 48 configured to receive the heel of the support hand. The placement of the swale 48 at the rear of the ridge 40 has the effect of increasing the effective height 49 of the rear face 41 of the ridge.

Figure 8:
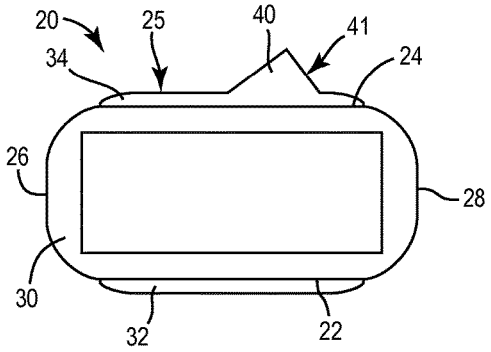
FIG. 8 is a bottom view of a pistol handle, according to another exemplary embodiment.
Figure 9:
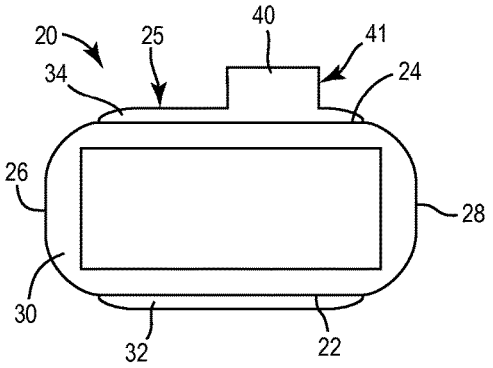
FIG. 9 is a bottom view of a pistol handle, according to another exemplary embodiment.
Figure 10:
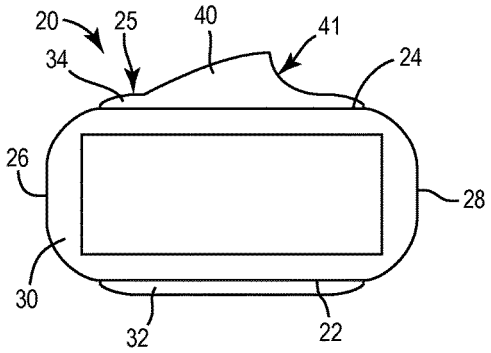
FIG. 10 is a bottom view of a pistol handle, according to another exemplary embodiment.

Referring now to FIGS. 8-10, in other embodiments, the ridge 40 may be otherwise shaped to provide a rear face 41 that is capable of transferring recoil force to the heel of the support hand gripping the handle 20. For example, the ridge may have a triangular cross-sectional shape (FIG. 8), a rectangular cross-sectional shape (FIG. 9), or a convex parabolic cross-sectional shape (FIG. 10). As shown, the ridge 40 may have a relatively discreet width or may have an expanded width. For example, the ridge 40 may extend forward from the rear face 41 to any point along the second side portion 24. In one exemplary embodiment, the ridge 40 extends to the front portion 26 of the handle 20. The height of the ridge may remain constant over the width of the ridge 40 or may decrease gradually from the rear face 41 of the ridge 40. The size and shape of the ridge 40 may be varied based on the size and shape of the shooter's hand. For example, at its widest point, the ridge may vary from about 0.5 inches to about 1 inch. The width may be adjusted depending on the shooter.

In one embodiment the ridge 40 may be formed of a relatively rigid material (e.g., a rigid polymer material, metal, wood, etc.). The ridge 40 may be integrally formed with the handle 20 (e.g., the second side portion 24) or may be a rigid body that is coupled to the handle 20 (e.g., coupled with mechanical fasteners, adhesives, etc.). In another exemplary embodiment, the ridge 40 may be formed of a pliable material (e.g., a rubberized polymer material, foam, etc.) coupled to a rigid backing material. For example, the ridge 40 may be formed of a pliable material (e.g., a pliable insert or coating) that is comolded with a rigid material in a two-shot injection molding process. In still another exemplary embodiment, the ridge 40 may be formed of a relatively rigid material and a pliable material may be applied to the handle (e.g., as a flexible sleeve or sheet that is coupled to the handle and conforms to the shape of the ridge 40. For example, the ridge 40 may be integrally formed with the handle 20 or may be provided as a rigid inset that is disposed between the sleeve and the handle 20.

According to the exemplary embodiment in FIGS. 6-10, the ridge 40 may be formed as a part of the second panel 34. In this way, a multitude of panels 32 and 34 may be provided for the pistol 10 to accommodate shooters with varied hand sizes and either left or right dominant hands (e.g., the ridge 40 may be provided on either the first side portion 22 or the second side portion 24).

However, the ridge 40 may be formed in a wide variety of manners such that advantageously provides a structure to transfer a portion of the recoil force to the support hand. In another embodiment, the ridge may be formed as a part of an underlying structure (e.g., the receiver 30). The second side panel 34 may then be formed in such a way that it fits over the ridge. For example, the second side panel 34 may be rigidly formed with a ridge that fits over the ridge of the receiver 30.

According to another exemplary embodiment, the ridge 40 may be provided as part of a flexible, resilient member (e.g., sleeve) that is slid onto the handle 20 or otherwise disposed on the handle 20. In some striker fired pistols, such as a Glock pistol, the lower receiver 30 is a single unitary body and the ridge 40 may be coupled to the handle 20 using a band, wrap around, or other fastener that extends around the periphery of the handle 20.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., movable, removable, or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the pistol grip as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method of steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A firearm comprising a trigger and a handle, wherein the handle is configured to be gripped by a hand of a user of the firearm and comprises:

a front portion located under the trigger and facing a firing direction;

a back portion located on a rear side of the handle facing a direction opposite of the firing direction; and primary and secondary side portions located between the front portion and the back portion, wherein the primary side portion is configured to receive a shooting hand of the user and the secondary side portion is configured to receive a support hand of the user;

wherein the secondary side portion includes an elongated ridge protruding away from a surface of the secondary side portion, wherein the ridge is configured to engage a heel of the support hand thereby allowing the support hand to absorb a portion of a recoil force when the firearm is fired, and wherein the secondary side portion includes a swale positioned to a rear of the ridge such that the height of a rear face of the ridge is increased to be offset from the height of a front face of the ridge.

2. The firearm of claim 1, wherein the ridge is curved.

3. The firearm of claim 1, wherein the swale is contoured to receive the heel of the support hand.

4. The firearm of claim 1, wherein the ridge extends greater than 50 percent of a vertical length of the secondary side portion.

5. The firearm of claim 1, wherein the secondary side portion includes a removable panel and wherein the ridge is located on the removable panel.

6. The firearm of claim 1, wherein the ridge is formed of pliable material.

7. The firearm of claim 1, wherein ridge protrudes at least 0.25 inches away from a surface of the secondary side portion.

8. A handgun including a handle with a grip assist feature, wherein the grip assist feature comprises a sleeve surrounding the handle, wherein the sleeve includes a protruding portion extending along a side of the handle so that that the protruding portion engages a heel of a non-shooting hand thereby allowing the non-shooting hand to absorb a portion of a recoil force when the handgun is fired, and wherein the sleeve further includes a swale positioned to a rear of the protruding portion such that the height of a rear face of the protruding portion is increased to be offset from the height of a front face of the protruding portion.

9. The handgun of claim 8, wherein the protruding portion extends substantially along the entire length of the side of the handle.

10. The handgun of claim 8, wherein the protruding portion comprises an elongated insert located within the sleeve.

11. The handgun of claim 10, wherein the insert has a cross-section that is one of circular, square, rectangular, or triangular geometry.

12. The handgun of claim 10, wherein the insert is integrated into the sleeve.

13. The handgun of claim 10, wherein a position of the insert relative to the sleeve is adjustable.

14. The handgun of claim 8, wherein the protruding portion extends in a curved shape.

15. The handgun of claim 8, wherein the shape of the protruding portion is adjustable by the user.

16. A firearm including a handle configured to be gripped by a shooting hand of a user, while a finger on the shooting hand of the user activates a trigger of the firearm, wherein the handle comprises:

primary and secondary side portions, wherein the primary side portion is configured to receive the shooting hand of the user and the secondary side portion is configured to receive a support hand of the user;

wherein the secondary side portion includes a grip assist feature configured to engage a heel of the support hand thereby allowing the support hand to absorb a portion of a recoil force when the firearm is fired; and wherein the secondary side portion includes a swale positioned to a rear of the grip assist feature such that the height of a rear face of the grip assist feature is increased to be offset from the height of a front face of the grip assist feature.

17. The firearm of claim 16, wherein the grip assist feature includes a protruding portion extending along at least a portion of a length of the secondary side portion.

18. The firearm of claim 17, wherein the grip assist feature includes a sleeve surrounding the handle and including the protruding portion.

19. The firearm of claim 16, wherein the grip assist feature includes pliable material.

20. The firearm of claim 16, wherein the grip assist feature includes a ridge extending along at least a portion of a length of the secondary side portion.

* * * * *